US010907350B1

(12) United States Patent
Shillingburg

(10) Patent No.: US 10,907,350 B1
(45) Date of Patent: Feb. 2, 2021

(54) MODULAR WALL BLOCK, INTERLOCKING BLOCK ASSEMBLY, AND RETAINING WALL CONSTRUCTED OF AN ASSEMBLY OF MODULAR WALL BLOCKS

(71) Applicant: RIDGEROCK RETAINING WALLS, INC., Charlotte, NC (US)

(72) Inventor: Curtis Shillingburg, Rock Hill, SC (US)

(73) Assignee: RIDGEROCK RETAINING WALLS, INC., Charlotte, NC (US)

( * ) Notice: Subject to any disclaimer, the term of this patent is extended or adjusted under 35 U.S.C. 154(b) by 0 days.

(21) Appl. No.: 16/244,599

(22) Filed: Jan. 10, 2019

(51) Int. Cl.
*E04B 5/00* (2006.01)
*E04B 2/02* (2006.01)

(52) U.S. Cl.
CPC ..... *E04C 1/24* (2013.01); *E04B 2/02* (2013.01); *E04B 2002/0232* (2013.01); *E04B 2002/0256* (2013.01)

(58) Field of Classification Search
CPC ..... E04C 1/24; E04B 2/02; E04B 2002/0256; E04B 2002/0232
USPC ..... 52/574
See application file for complete search history.

(56) References Cited

U.S. PATENT DOCUMENTS 982,291 A * 1/1911 Myers ..... E04B 2/22 52/574
1,356,590 A * 10/1920 Baumann ..... E04B 2/22 52/574
1,414,246 A * 4/1922 Ager ..... E04B 2/02 52/100
2,126,012 A * 8/1938 Hedinger ..... E04B 2/42 52/286
2,308,790 A * 1/1943 Stagg ..... E04C 1/24 52/550
3,418,774 A * 12/1968 Kocher ..... E04B 2/22 52/437
3,650,079 A * 3/1972 Lubin ..... E04B 2/50 52/316
3,717,967 A * 2/1973 Wood ..... E04B 2/54 52/259
3,802,205 A * 4/1974 Dickinson ..... E02D 29/0266 405/285
3,802,659 A * 4/1974 Lebherz ..... B28B 13/04 249/52
3,873,225 A * 3/1975 Jakobsen ..... E01C 5/00 404/41

(Continued)

FOREIGN PATENT DOCUMENTS

DE 202017105685 U1 * 12/2017 ..... E04B 2/24
GB 488640 A * 7/1938 ..... E04B 2/42

*Primary Examiner* — Patrick J Maestri
*Assistant Examiner* — Joseph J. Sadlon
(74) *Attorney, Agent, or Firm* — Schwartz Law Firm, P.C.

(57) ABSTRACT

A modular wall block is adapted for being assembled together with a number of other blocks in stacked courses to form a retaining wall. First and second spaced apart T-shaped formations are located at a rear of the block body, and define therebetween a T-shaped vertical fastener channel and opposing vertical side grooves. The vertical fastener channel is adapted for receiving a complementary T-shaped formation of a rearwardly placed embedment block. The vertical side grooves are adapted for cooperating with vertical side grooves of adjacent like wall blocks to selectively receive a removable wall insert.

16 Claims, 10 Drawing Sheets

(56) References Cited

U.S. PATENT DOCUMENTS 4,041,670 A * 8/1977 Kaplan ..... E04B 2/18 52/592.2
4,123,881 A * 11/1978 Muse ..... E04B 2/44 52/100
D250,484 S * 12/1978 Muse ..... D25/116
4,172,344 A * 10/1979 Childress, Jr. ..... E04B 2/02 52/314
4,175,888 A * 11/1979 Ijima ..... E02B 3/06 405/31
4,370,075 A * 1/1983 Scales ..... E01C 9/004 405/20
4,372,091 A * 2/1983 Brown ..... E04B 2/46 52/592.6
4,379,659 A * 4/1983 Steiner ..... A01G 9/025 405/284
D284,514 S * 7/1986 McPoyle ..... D25/118
4,601,148 A * 7/1986 Risi ..... A01G 9/025 52/284
4,698,949 A * 10/1987 Dietrich ..... E04B 2/44 52/415
4,703,602 A * 11/1987 Pardo ..... E02D 29/0241 52/223.7
4,854,097 A * 8/1989 Haener ..... E04C 1/41 52/309.11
4,896,999 A * 1/1990 Ruckstuhl ..... E04C 1/395 405/286
5,127,770 A * 7/1992 Ditcher ..... E02D 29/0233 405/262
5,503,498 A * 4/1996 Scheiwiller ..... E01C 5/00 404/34
5,687,531 A * 11/1997 Nelson ..... E04B 2/08 110/338
5,688,078 A 11/1997 Hammer
D387,434 S * 12/1997 Dawson ..... E04B 1/4114 D25/118
5,704,183 A * 1/1998 Woolford ..... B28B 7/0097 405/284
5,941,042 A * 8/1999 Dueck ..... E04C 1/395 405/286
5,951,210 A * 9/1999 Maguire ..... E02D 29/0225 405/284
D434,857 S * 12/2000 Scheiwiller ..... D25/113
6,474,036 B2 * 11/2002 Martin ..... E02D 29/025 405/284
6,561,730 B2 * 5/2003 Yang ..... E02B 3/06 405/16
6,632,048 B2 * 10/2003 Greenberg ..... E02D 29/0283 405/262
6,863,469 B2 * 3/2005 Bolduc ..... E01C 5/06 404/34
6,988,847 B2 * 1/2006 Lazar ..... E01C 5/00 404/34
7,096,635 B2 * 8/2006 Price ..... E04C 1/39
D548,367 S * 8/2007 Price ..... E04B 1/04 D25/113
7,367,752 B2 * 5/2008 Price ..... E04B 2/30 52/285.2
7,390,146 B2 6/2008 Rainey
7,396,190 B2 7/2008 Price
7,410,328 B2 8/2008 Hamel
7,497,646 B2 * 3/2009 Price ..... B28B 17/0018 D25/118
7,503,729 B2 * 3/2009 Hammer ..... E02D 29/0225 D25/113
7,837,415 B2 11/2010 Allington et al.
7,987,646 B2 * 8/2011 Race ..... E04F 13/185 52/506.01
8,015,772 B2 * 9/2011 Jensen ..... E01C 5/20
8,099,918 B2 * 1/2012 Marsh ..... E04B 2/30 52/285.2
8,141,315 B1 * 3/2012 Shillingburg ..... E04C 1/395 405/286
8,209,924 B2 * 7/2012 Foley ..... E04B 1/4114 52/289
8,350,256 B2 1/2013 Chen et al.
8,371,086 B1 * 2/2013 Shillingburg ..... E04C 1/395 405/286
8,708,608 B2 4/2014 Bott
8,833,007 B2 * 9/2014 Tillery ..... E01C 5/06 404/34
8,851,803 B2 10/2014 Bott
8,863,465 B2 10/2014 Bott
8,887,469 B2 * 11/2014 MacDonald ..... B28B 7/0097 405/284
9,003,734 B2 * 4/2015 Bott ..... E02D 29/025 52/568
9,068,342 B2 * 6/2015 D'Avela ..... E04B 1/04
9,238,910 B2 * 1/2016 Jensen ..... E04B 2/46 52/592.6
9,410,299 B2 * 8/2016 Pierce, Jr. ..... E02B 3/062
9,885,177 B2 * 2/2018 Gomes ..... E04C 1/39
9,890,512 B2 2/2018 Castonguay et al.
9,951,527 B2 * 4/2018 Lundell ..... E01C 5/20
10,316,485 B1 * 6/2019 Ness ..... E02D 29/025 52/568
10,330,315 B2 * 6/2019 Bowser, Jr. ..... C10B 29/02
10,501,929 B2 * 12/2019 Henry ..... E04B 1/2604
10,501,932 B1 * 12/2019 Rulon ..... E04B 2/18
10,760,269 B2 * 9/2020 Lundell ..... E02D 29/025

* cited by examiner

MODULAR WALL BLOCK, INTERLOCKING BLOCK ASSEMBLY, AND RETAINING WALL CONSTRUCTED OF AN ASSEMBLY OF MODULAR WALL BLOCKS

TECHNICAL FIELD AND BACKGROUND OF INVENTION

This disclosure relates broadly to a modular wall block and retaining wall constructed of an assembly of such blocks in stacked courses. In one exemplary implementation, the exemplary wall block described herein is applicable for landscaping around residential and commercial structures to retain and preserve the surrounding soil while promoting the aesthetics of the area.

Conventional retaining walls formed of concrete blocks are constructed in stacked courses with the ascending courses typically setback to counter the pressure of the soil acting against the wall. One such commercially available wall block is described in Applicant's prior issued U.S. Pat. Nos. 8,141,315 and 8,371,086 entitled "Modular Wall Block with Block-locating Jut and Shear Lug." The complete disclosure of these prior patents is incorporated herein by reference.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises a modular wall block adapted for being assembled together with a number of other blocks in stacked courses to form a retaining wall. The wall block comprises a block body having a front and rear, top and bottom, and opposing sides. The top and bottom define respective substantially planar stacking surfaces. First and second spaced apart T-shaped formations are located at the rear of the block body, and define therebetween a T-shaped vertical fastener channel and opposing vertical side grooves. The vertical fastener channel is adapted for receiving a complementary T-shaped formation of a rearwardly placed embedment block. The vertical side grooves are adapted for cooperating with vertical side grooves of adjacent like wall blocks to selectively (optionally) receive a removable wall insert. The wall insert creates a substantially closed-off fill cavity between the adjacent wall blocks.

According to another exemplary embodiment, a shear lug projects from one of the planar stacking surfaces of the block body.

According to another exemplary embodiment, a block-locating jut is formed with at least one of the opposing sides of the block body, and projects from the side towards one of the planar stacking surfaces.

According to another exemplary embodiment, the block-locating jut defines a base surface substantially coplanar with the stacking surface of the block body, and a lug-engaging shoulder adapted for engaging a shear lug of a wall block located in an adjacent stacked course.

According to another exemplary embodiment, the block-locating jut projects from the side of the block body at a point intermediate the top and bottom towards the planar stacking surface.

In another exemplary embodiment, the present disclosure comprises an interlocking block assembly adapted for incorporating in a retaining wall. The block assembly comprises a face block and an rearwardly disposed embedment block. The face block includes a face block body having a front and rear, top and bottom, and opposing sides. The top and bottom define respective substantially planar stacking surfaces. First and second spaced apart T-shaped formations are located at the rear of the face block body and define therebetween a T-shaped vertical fastener channel. The embedment block comprises an embedment block body having a front and rear, top and bottom, and opposing sides. The top and bottom define respective substantially planar stacking surfaces. A front T-shaped formation is located at the front of the embedment block body and is received into the vertical fastener channel of the face block body, thereby interlocking the face block and the embedment block together. First and second spaced apart rear T-shaped formations are located at the rear of the embedment block body and define therebetween a T-shaped vertical fastener channel of the embedment block.

According to another exemplary embodiment, the first and second rear T-shaped formations of the face block further define opposing vertical side grooves.

According to another exemplary embodiment, a removable wall insert is optionally positioned within the vertical side grooves of adjacent like face blocks. The wall insert creates a substantially closed-off fill cavity between the adjacent face blocks.

According to another exemplary embodiment, the wall insert defines a plurality of spaced apart vertical drainage cuts extending from an edge of the insert.

According to another exemplary embodiment, the first and second rear T-shaped formations of the embedment block further define opposing vertical side grooves.

According to another exemplary embodiment, a removable wall insert is optionally positioned within the vertical side grooves of adjacent like embedment blocks. The wall insert creates a substantially closed-off fill cavity between the adjacent embedment blocks and adjacent face blocks.

In yet another exemplary embodiment, the present disclosure comprises a retaining wall constructed of an assembly of modular wall blocks, as described herein, arranged in stacked courses. The exemplary wall blocks may be fabricated in a variety of sizes including, for example, 9-inch deep, 12-inch deep, and 21-inch deep.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
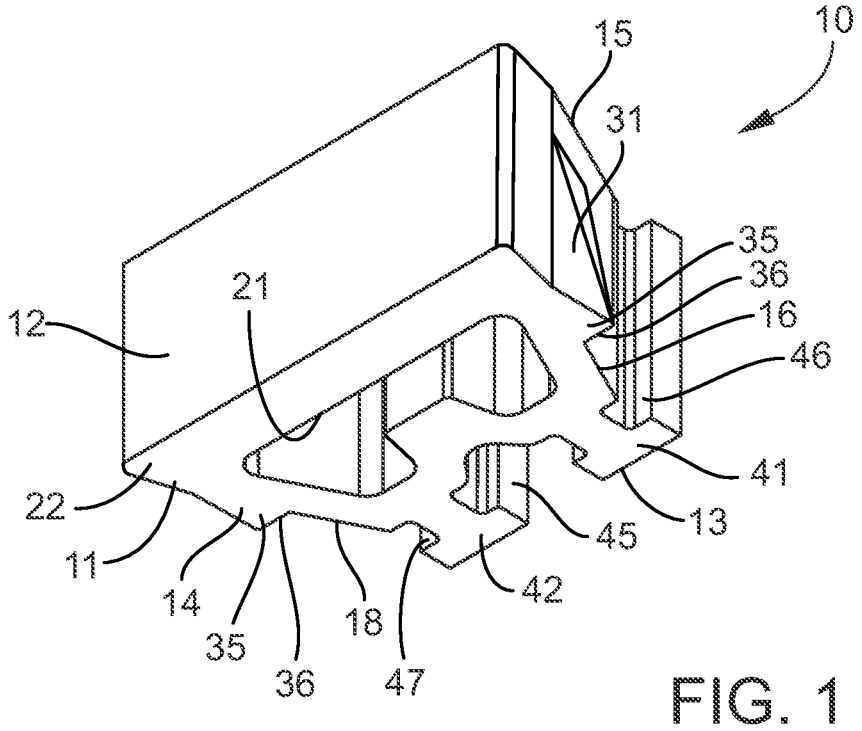
FIGS. 1 and 2 are isometric views of a modular face block according to one exemplary embodiment of the present disclosure.
Figure 2:
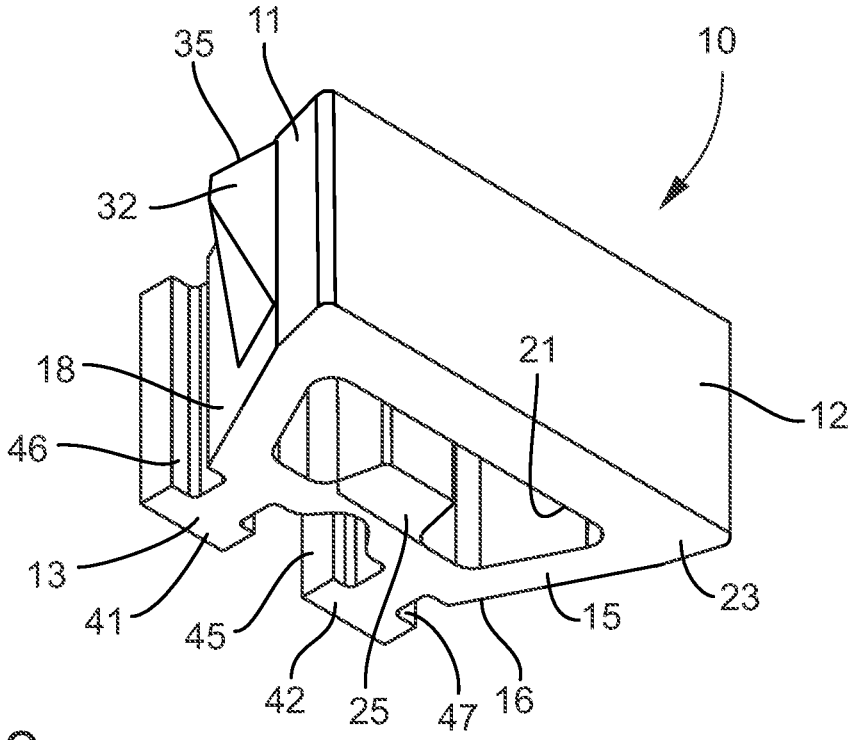
Figure 3:
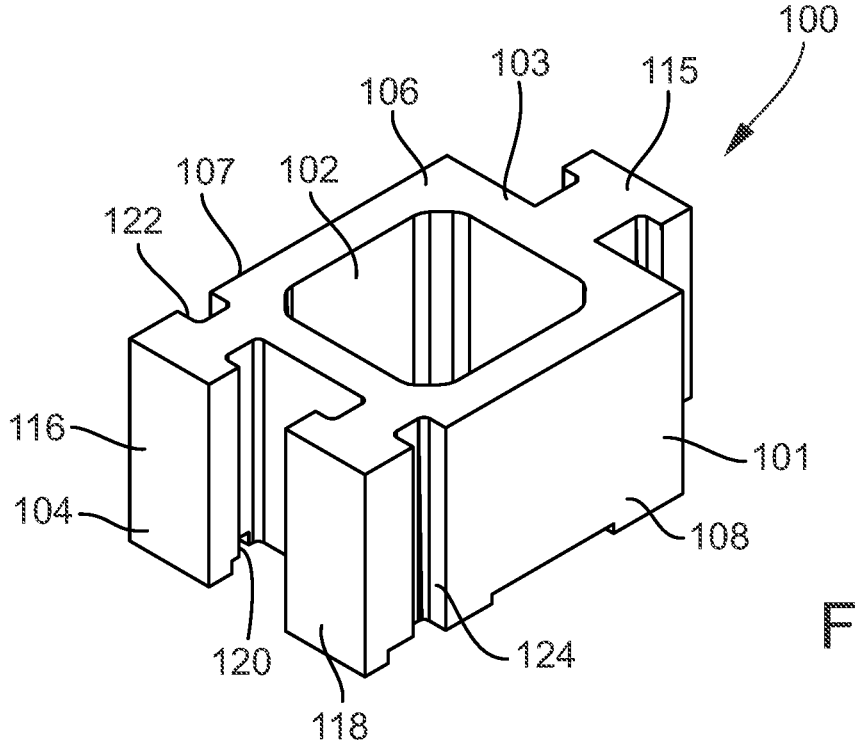
FIGS. 3 and 4 are isometric views of a modular embedment block according to an exemplary embodiment of the disclosure.
Figure 4:
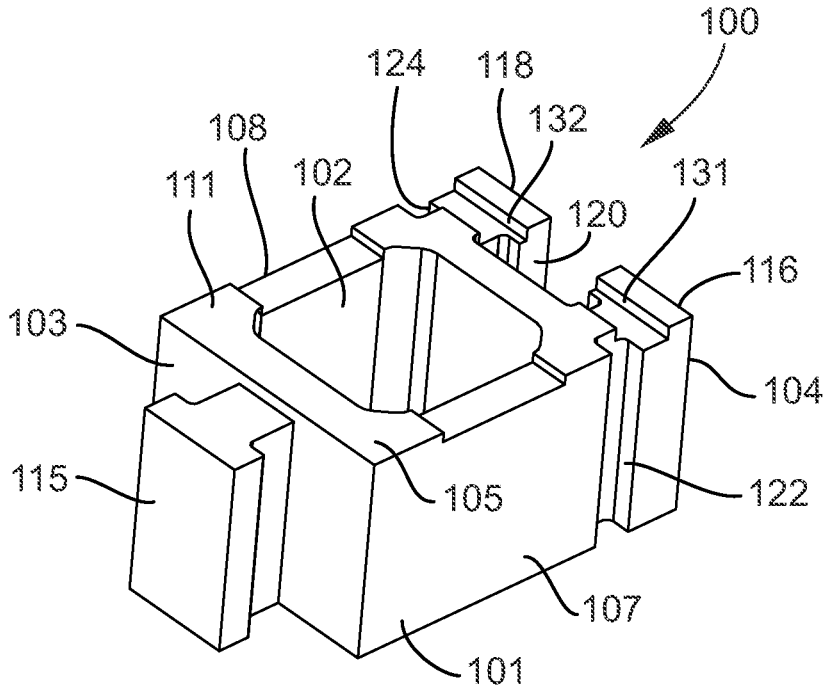
Figure 6:
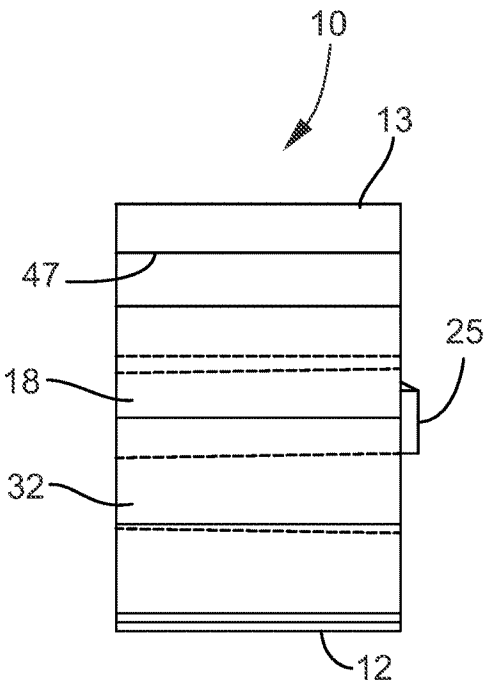
FIGS. 5, 6, and 7 are further views of the exemplary face block.
Figure 7:
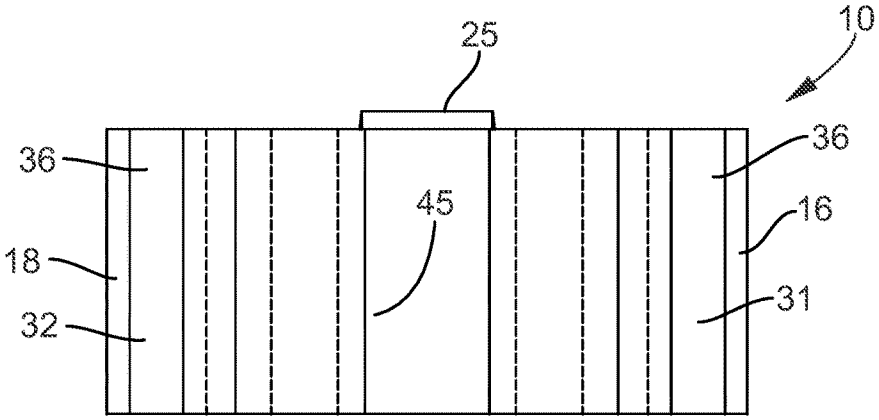
Figure 14:
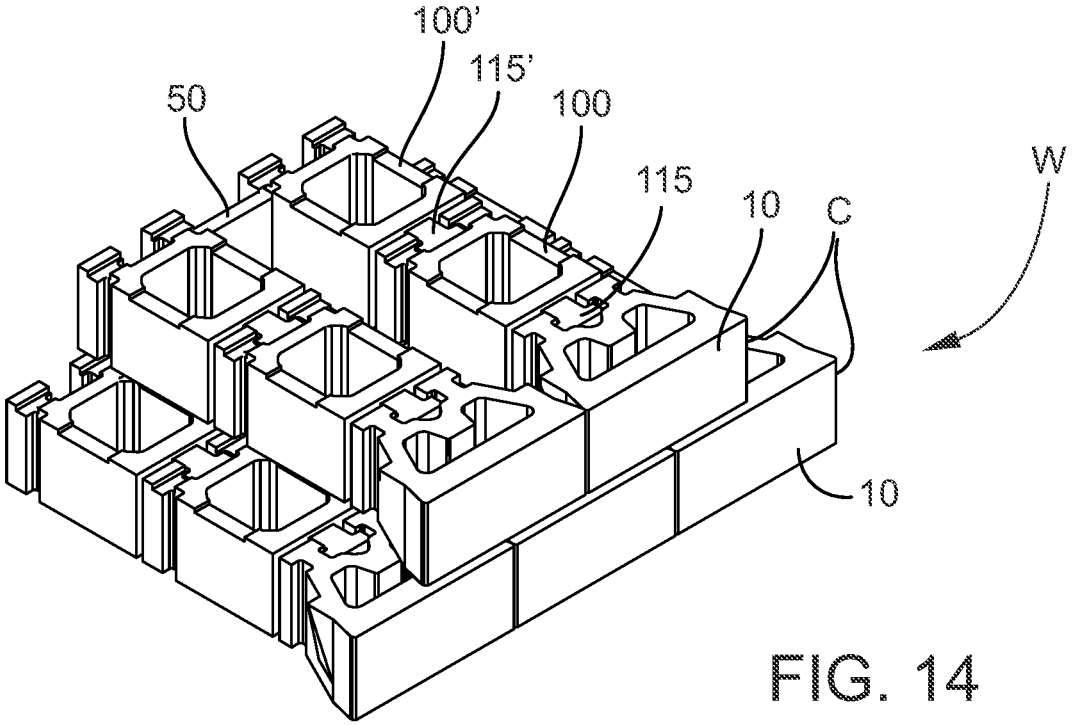
FIGS. 14 and 15 are isometric views of a partially constructed retaining wall incorporating the present face blocks and embedment blocks.
Figure 15:
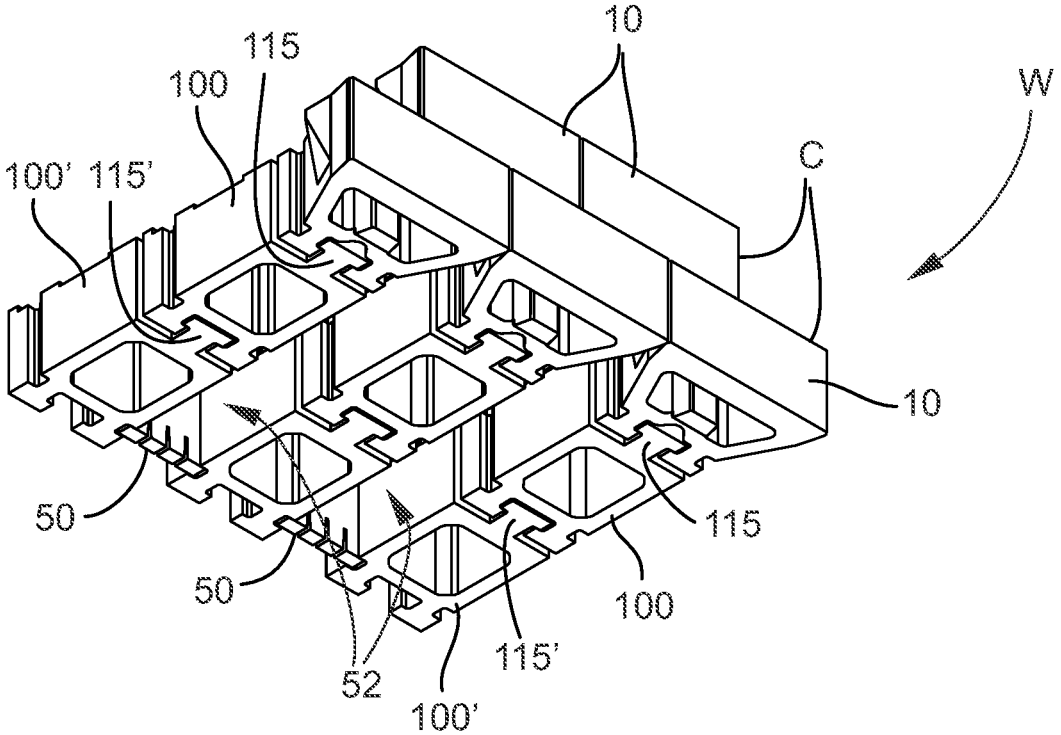

Referring now specifically to the drawings, a modular face block according to one exemplary embodiment of the present invention is illustrated in FIGS. 1 and 2, and shown generally at reference numeral 10. The exemplary face block 10 is adapted for being interlocked with a modular embedment block 100, illustrated in FIGS. 3 and 4. The interlocked face block 10 and embedment block 100 are assembled together, as shown in FIGS. 14 and 15, with a number of other interlocked blocks in stacked courses "C" to form a retaining wall "W". The exemplary embedment block 100 may be utilized in wall "W" in substitution of (or in addition to) mechanical means, such as geogrid mats or tie-backs, to help stabilize the soil and further anchor the face blocks 10 in the wall. In alternative applications, the exemplary face block 10 may be incorporated into a retaining wall without the interlocked embedment block 100 using other restraining systems, including the aforementioned geogrid mats. Each of the modular blocks 10, 100 may be integrally formed (e.g., molded) as a single homogenous unit of any suitable material including, for example, masonry concrete. Alternatively, either of the exemplary blocks 10, 100 may be fabricated in two or more interconnected masonry and/or non-masonry parts.

Exemplary Face Block 10

As best shown in FIGS. 1, 2 and 5-7 the exemplary face block 10 comprises an integrally-molded block body 11 having a front and rear 12, 13, top and bottom 14, 15, and opposing inwardly angled sides 16, 18. In the exemplary embodiment, the front 12 includes a substantially straight planar face having an aesthetic, unfinished, rough textured surface. The block body 11 may comprise a substantially hollow core 21 to reduce the overall weight of the face block 10, and for convenient handling and placement of the block 10 during construction of the retaining wall or other structure. The top and bottom 14, 15 of block body 11 form respective substantially planar stacking surfaces 22, 23. An integrally-formed shear lug 25, shown in FIGS. 2 and 5-7, is located between the front 12 and rear 13 of the block body 11 and projects from the stacking surface 23 of the bottom 15. Respective identical block-locating juts 31, 32 are integrally-formed with opposing sides 16, 18 of the block body 11, and project from each side at a point intermediate the top and bottom 14, 15 towards the planar stacking surface 22 opposite the shear lug 25. Each jut 31, 32 has a base surface 35 substantially coplanar with the stacking surface 22, and forming a lug-engaging shoulder 36 adapted for engaging a shear lug of a face block located in an adjacent stacked course. The lug-engaging shoulder 36 may project between 0.25 and 2.00 inches beyond the side 16, 18 of the block body 11.

As described further in Applicant's prior U.S. Pat. Nos. 8,141,315 and 8,371,086, the shear lugs 25 and block-locating juts 31, 32 of adjacent stacked courses cooperate to vertically register and align the face blocks 10 in the retaining wall. In one implementation, a single upper-course face block 10 is stacked upon two identical side-by-side face blocks 10 in the adjacent lower course. In this arrangement, the lug-engaging shoulders 36 of respective juts 31, 32 bear directly against the downward projecting shear lug 25 of the upper-course face block 10. After properly aligning the upper-course face block 10, the exemplary embedment block 100 is interlocked, as described further below, and stacked upon two side-by-side lower-course embedment blocks 100 in the retaining wall.

Figure 5:
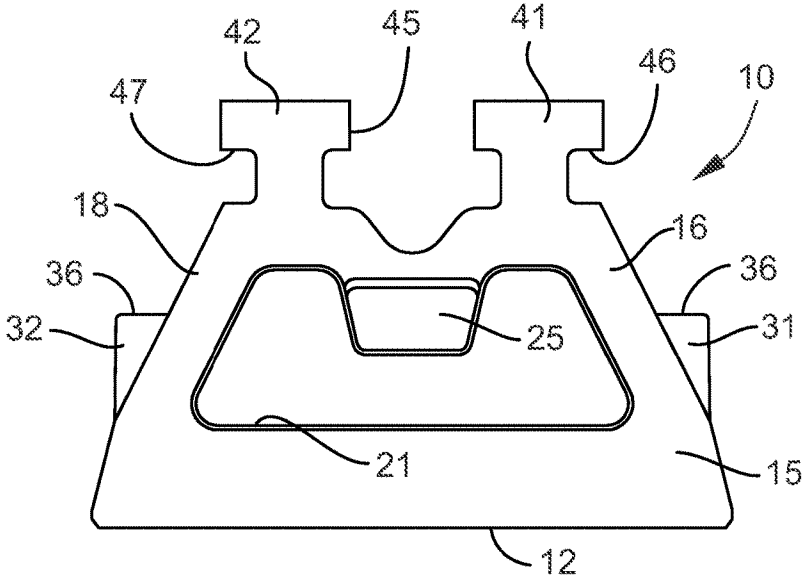
Figure 9:
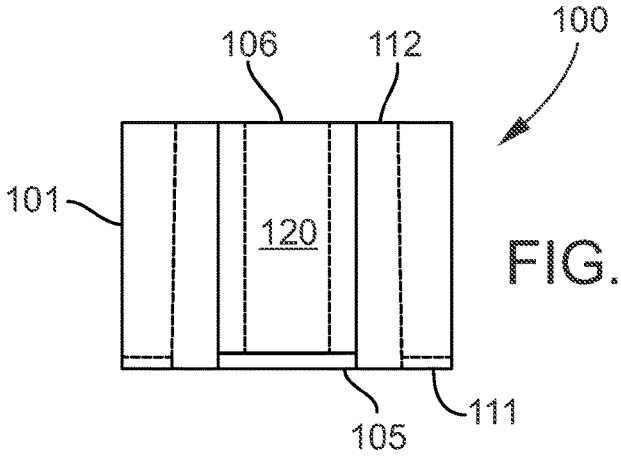
FIGS. 8, 9, 10, and 11 are further views of the exemplary embedment block.
Figure 11:
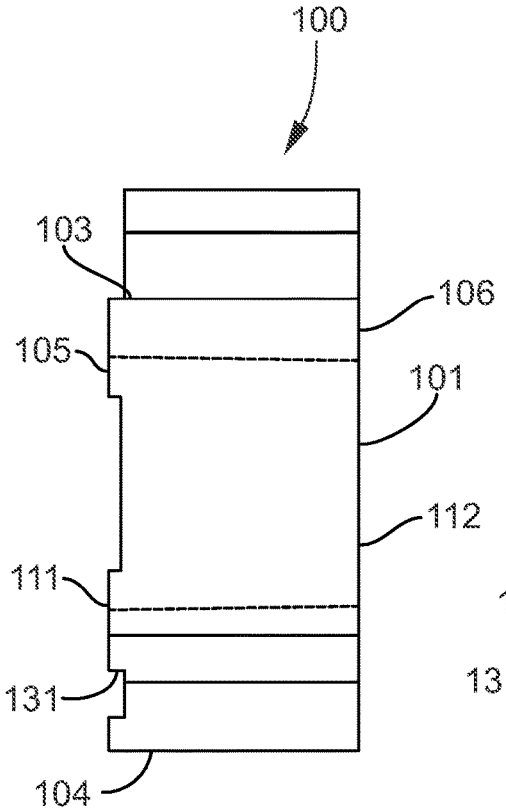
Figure 8:
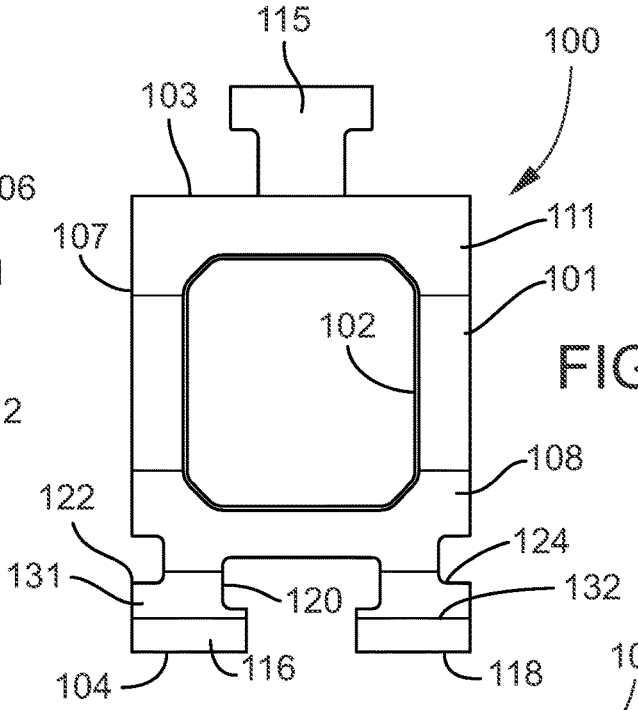
Figure 10:
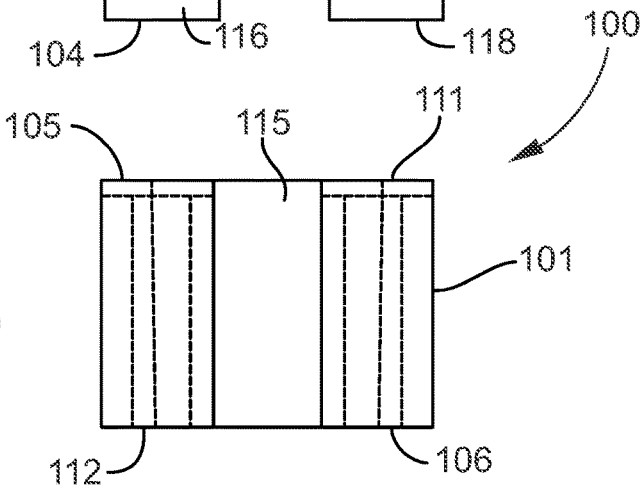
Figure 12:
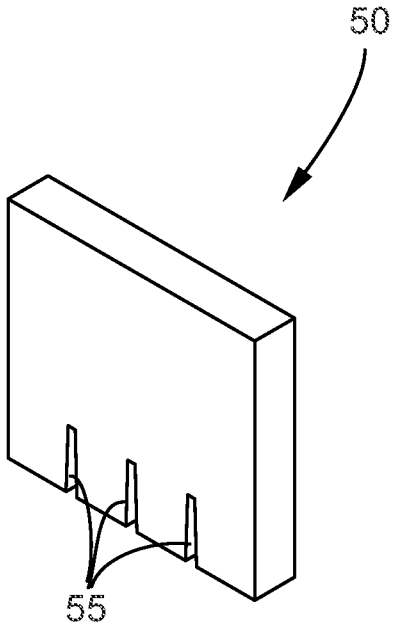
FIGS. 12 and 13 are views of an exemplary optional wall insert.
Figure 13:
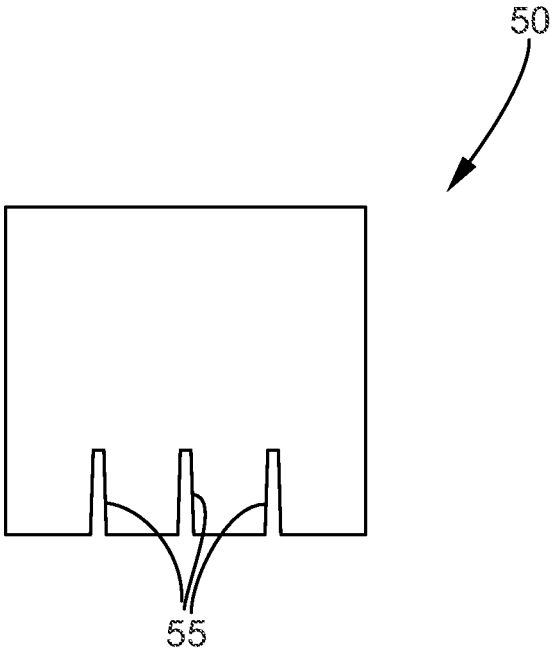

Referring to FIGS. 1, 2, and 5, first and second spaced apart T-shaped formations 41, 42 are located at the rear 13 of the block body 11, and define therebetween a T-shaped vertical fastener channel 45 and opposing vertical side grooves 46, 47. The vertical fastener channel 45 is designed to receive a complementary T-shaped formation of a rearwardly placed embedment block 100, described below, and the vertical side grooves 46, 47 are adapted to cooperate with vertical side grooves of adjacent like face blocks 10 to optionally receive a removable wall insert 50 (See FIGS. 12-15). The wall insert 50 creates a substantially closed-off fill cavity 52 between side-by-side face blocks 10. The fill cavity 52 may receive and retain backfill material such as coarse aggregate to promote wall stability and drainage. The exemplary wall insert 50 may also comprise a plurality of spaced vertical drainage cuts 55 formed at its edge.

Exemplary Embedment Block 100

Referring to FIGS. 3, 4, and 8-11, the exemplary modular embedment block 100 comprises a block body 101 defining a hollow core 102, and having a front and rear 103, 104, top and bottom 105, 106, and opposing sides 107, 108. The top and bottom 105, 106 define respective generally planar stacking surfaces 111, 112. A vertical T-shaped formation 115 is located at the front 103 of the block body 101 and is designed to be received into the vertical fastener channel 45 of the face block 10, as illustrated in FIGS. 14 and 15, thereby interlocking the face block 10 and the embedment block 100 together. The front formation 115 may extend vertically from the bottom 106 of the block body 101 to a point slightly below the top 105, such that its shorter length avoids interfering with the placement of blocks 100 in successive courses "C" in the retaining wall "W".

In the exemplary embedment block 100, first and second spaced-apart T-shaped formations 116, 118 (corresponding substantially to the formations 41, 42 of face block 10) are located at the rear 104 of the block body 101. The exemplary formations 116, 118 cooperate to form a T-shaped vertical fastener channel 120 of the embedment block 100, and opposing vertical side grooves 122, 124. The rear vertical fastener channel 120 may receive a complementary T-shaped formation 115' of a second like embodiment block 100', as shown in FIGS. 14 and 15, to further extend (or "deepen") the interlocked block structure rearwardly from the face block 10. The vertical side grooves 122, 124 cooperate with vertical side grooves of adjacent side-by-side embodiment blocks 100 to optionally receive the wall insert 50 shown in FIGS. 12-15 and described above. The bottom edge of wall insert 50 may sit within horizontal grooves 131, 132 located along top ends of vertical formations 116, 118 of underlying adjacent embedment blocks 100, thereby increasing shear resistance of the wall "W".

Figure 16:
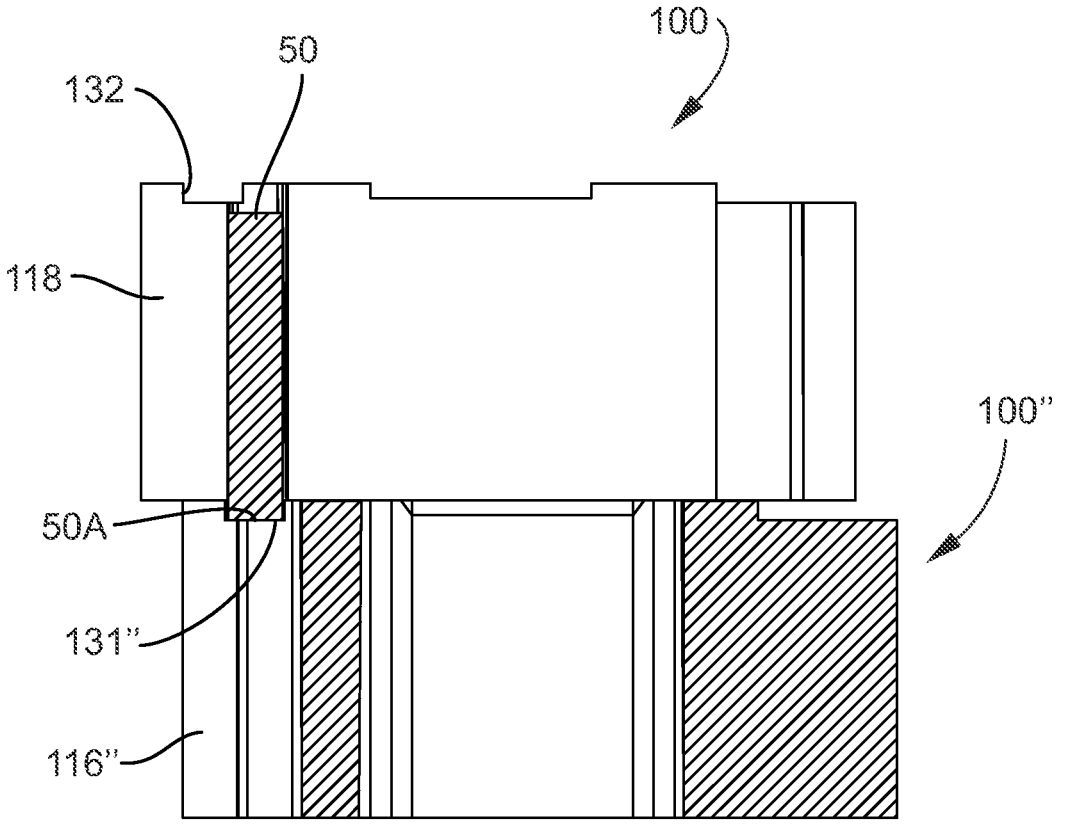
FIG. 16 is a cross-sectional view taken through the wall insert in stacked embedment blocks.

FIG. 16 shows the bottom edge 50A of wall insert 50 positioned within horizontal groove 131" located along the top end of vertical formation 116" of underlying embedment block 100"—like elements of blocks 100 and 100" being indicated in double prime (") notation. Additionally, the top 105 of the block body 101 may be slightly recessed along opposing sides 107, 108 to accommodate existing surface irregularities and promote proper block alignment, stability and stacking of adjacent courses. The relatively large core 102 of the block body 101 may align vertically with the hollow cores of stacked embedment blocks 100 to receive fence posts, guardrails, and other such structure.

Exemplary Block Connector 60

Figure 17:
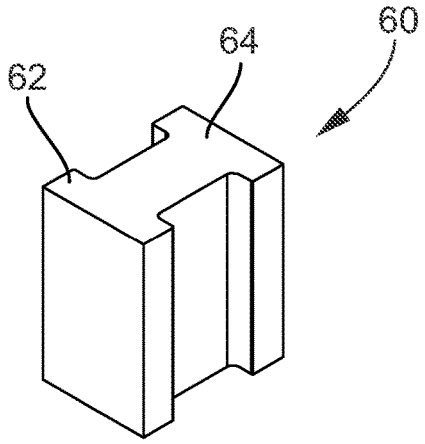
FIGS. 17-19 illustrate use of an exemplary block connector for interlocking two adjacent face blocks, and two face blocks and an adjacent embedment block.
Figure 18:
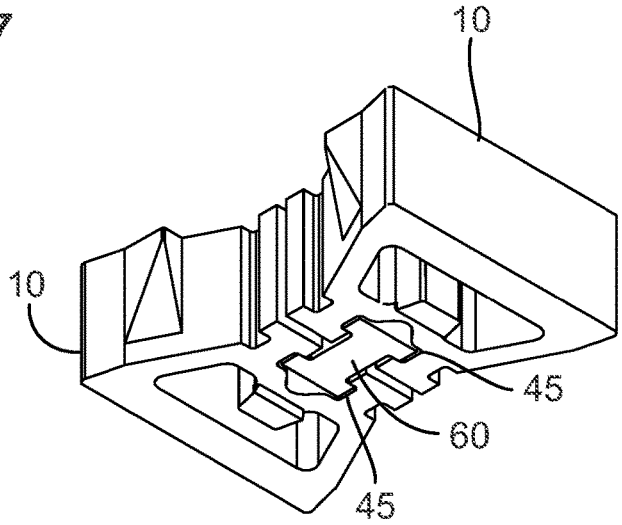
Figure 19:
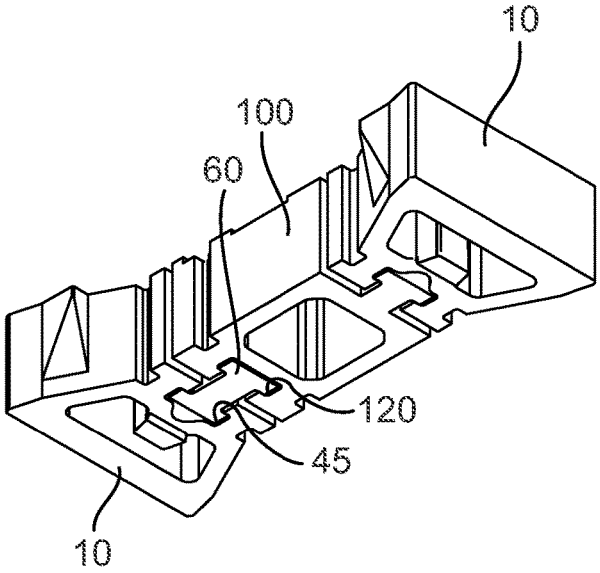

A block connector 60 shown in FIG. 17 may be utilized to directly couple (or interlock) two identical face blocks 10 in the manner illustrated in FIG. 18, or may be utilized to indirectly couple the face blocks 10 with an intermediate embedment block 100 in the manner illustrated in FIG. 19. The block connector 60 is especially useful in constructing double sided walls having an exposed finished appearance on both sides. In the exemplary embodiment, the present block connector 60 comprises opposing integrally-molded T-shaped formations 62, 64 designed to insert within respective T-shaped fastener channels 45, 120 of the adjacent face blocks 10 and embedment blocks 100. The block connector 60 may molded of a masonry concrete, glass-filled nylon, or other suitable material.

Alternative Face Block 200 with Deep Block Body

Figure 20:
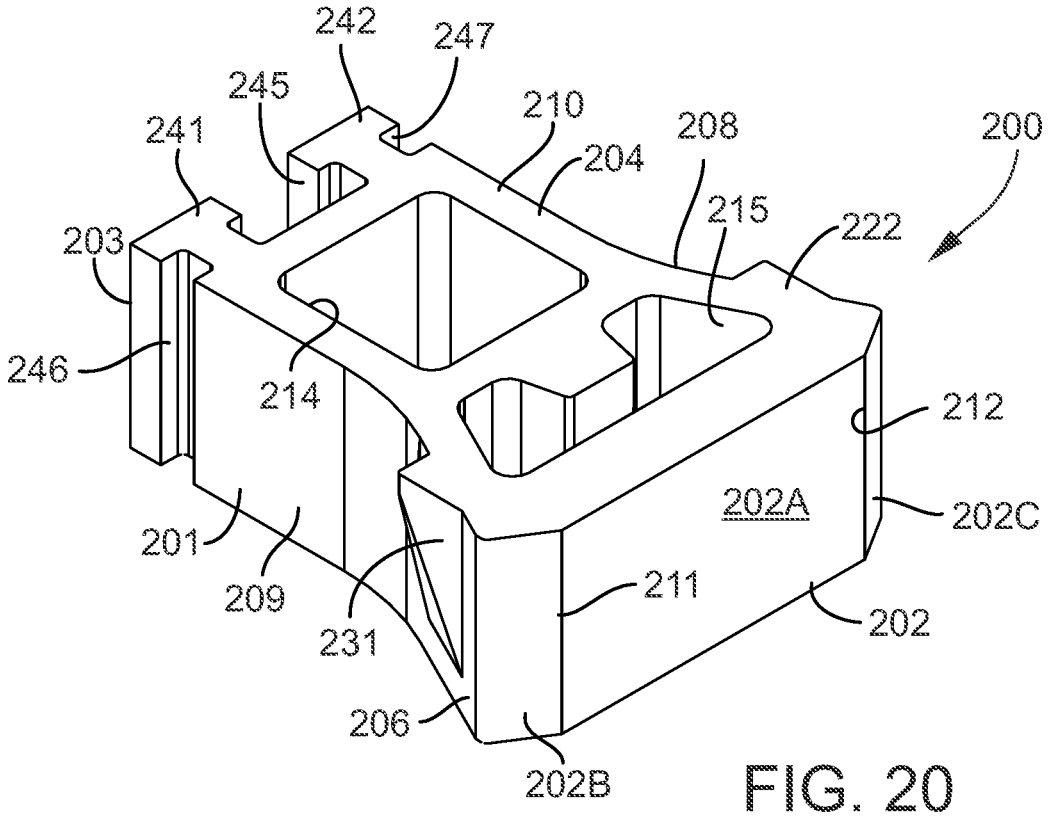
FIGS. 20-22 are views of a deep-body face block according to an alternative exemplary embodiment of the present disclosure.
Figure 21:
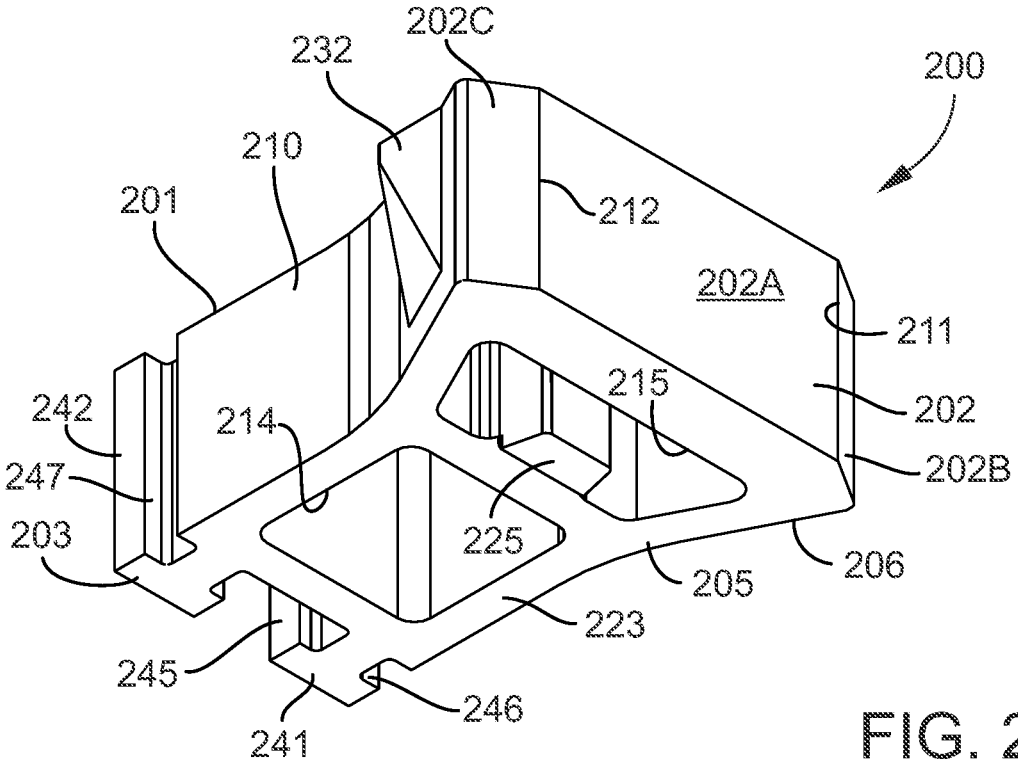
Figure 22:
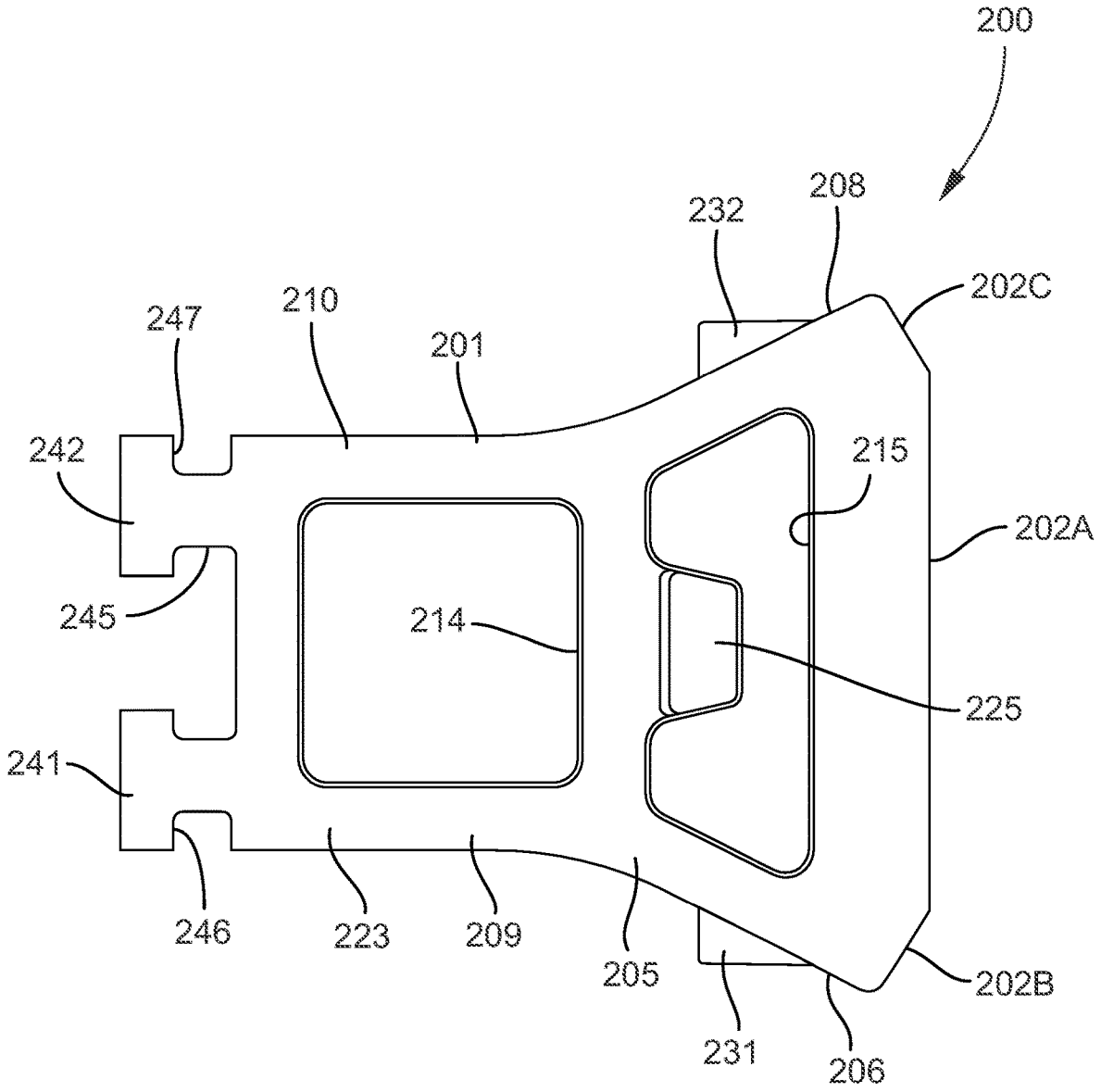

An alternative exemplary face block 200 according to the present disclosure is illustrated in FIGS. 20, 21 and 22. Face block 200 comprises an integrally-molded deep block body 201 having a front and rear 202, 203, top and bottom 204, 205, and opposing inwardly angled front sides 206, 208, and substantially straight rear sides 209, 210. The front 202 includes vertical breaks 211, 212 defining a center face portion 202A and opposing side face portions 202B, 202C. The center face portion 202A may have an aesthetic, unfinished, rough textured surface. The deep block body 201 comprises substantially hollow front and rear cores 214, 215 designed to reduce the overall weight of the face block 200, and for convenient handling and placement of the block 200 during construction of a retaining wall or other structure. The top and bottom 204, 205 of face block 200 form respective substantially planar stacking surfaces 222, 223. An integrally-formed shear lug 225, such as lug 25 of block 10 previously described, is located between the front 202 and rear 203 of the block body 201 and projects from the stacking surface 223 of the bottom 205. Respective identical block-locating juts 231, 232, such as juts 31, 32 of block 10 previously described, are integrally-formed with opposing front sides 206, 208 of the block body 201, and project from each side at a point intermediate the top and bottom 204, 205 towards the planar stacking surface 222 opposite the shear lug 225.

First and second spaced apart T-shaped formations 241, 242 are located at the rear 203 of the block body 201 adjacent the rear sides 209, 210, and define therebetween a T-shaped vertical fastener channel 245 and opposing vertical side grooves 246, 247. Like fastener channel 45 of face block 10, the fastener channel 245 is designed for receiving a complementary T-shaped formation of a rearwardly placed embedment block (See, e.g., FIGS. 14 and 15) or block connector, and the vertical side grooves 246, 247 are adapted to cooperate with vertical side grooves of adjacent like face blocks 200 to optionally receive a removable wall insert, as insert 50 previously described.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

I claim:

1. A modular wall block adapted for being assembled together with a number of other blocks in stacked courses to form a retaining wall, said wall block comprising:

a block body having a front and rear, top and bottom, and opposing sides, and an intermediate block wall located between said front and rear and extending between said opposing sides, said top and bottom defining respective substantially planar stacking surfaces;

first and second spaced apart T-shaped formations located at the rear of said block body, and defining therebetween a T-shaped vertical fastener channel and opposing vertical side grooves, and wherein said vertical fastener channel is adapted for receiving a complementary T-shaped formation of a rearwardly placed embedment block, and wherein said vertical side grooves are adapted for cooperating with vertical side grooves of adjacent like wall blocks to selectively receive a removable wall insert; and a shear lug formed with said intermediate block wall between said first and second T-shaped formations and projecting from one of the planar stacking surfaces of said block body.

2. The modular wall block according to claim 1, and comprising a block-locating jut formed with at least one of the opposing sides of said block body, and projecting from the side towards one of the planar stacking surfaces.

3. An interlocking block assembly adapted for incorporating in a retaining wall, said block assembly comprising:

a face block comprising:

(i) a face block body having a front and rear, top and bottom, and opposing sides, said top and bottom defining respective substantially planar stacking surfaces; and (ii) first and second spaced apart T-shaped formations located at the rear of said face block body and defining therebetween a T-shaped vertical fastener channel;

an embedment block comprising:

(i) an embedment block body having a front and rear, top and bottom, and opposing sides, said top and bottom defining respective first and second substantially planar stacking surfaces, and wherein each side of said block body has an intermediate portion which extends vertically from a first point coplanar to one of said first and second stacking surfaces to a second point spaced apart from another of said first and second stacking surfaces; and (ii) a front T-shaped formation located at the front of said embedment block body and received into said vertical fastener channel of said face block body, thereby interlocking said face block and said embedment block together; and (iii) first and second spaced apart rear T-shaped formations located at the rear of said embedment block body and defining therebetween a T-shaped vertical fastener channel of said embedment block.

4. The interlocking block assembly according to claim 3, wherein said first and second rear T-shaped formations of said face block further define opposing vertical side grooves.

5. The interlocking block assembly according to claim 4, and comprising a removable wall insert positioned within the vertical side grooves of adjacent like face blocks, whereby the wall insert creates a substantially closed-off fill cavity between the adjacent face blocks.

6. The interlocking block assembly according to claim 5, wherein said wall insert defines a plurality of spaced apart vertical drainage cuts extending from an edge of said insert.

7. The interlocking block assembly according to claim 3, wherein said first and second rear T-shaped formations of said embedment block further define opposing vertical side grooves.

8. The interlocking block assembly according to claim 7, and comprising a removable wall insert positioned within the vertical side grooves of adjacent like embedment blocks, whereby the wall insert creates a substantially closed-off fill cavity between the adjacent embedment blocks and adjacent face blocks.

9. The interlocking block assembly according to claim 8, wherein said wall insert defines a plurality of spaced apart vertical drainage cuts extending from an edge of said insert.

10. The interlocking block assembly according to claim 3, wherein said face block comprises a shear lug projecting from one of the planar stacking surfaces of said block body.

11. The interlocking block assembly according to claim 10, wherein said face block comprises a block-locating jut formed with at least one of the opposing sides of said block body, and projecting from the side towards one of the planar stacking surfaces.

12. The interlocking block assembly according to claim 11, wherein said block-locating jut defines a base surface substantially coplanar with the stacking surface of said block body, and a lug-engaging shoulder adapted for engaging a shear lug of a wall block located in an adjacent stacked course.

13. The interlocking block assembly according to claim 12, wherein said block-locating jut projects from the side of said block body at a point intermediate the top and bottom towards the planar stacking surface.

14. A retaining wall constructed of an assembly of modular wall blocks arranged in stacked courses, each of said wall blocks comprising:

a block body having a front and rear, top and bottom, and opposing sides, and an intermediate block wall located between said front and rear and extending between said opposing sides, said top and bottom defining respective substantially planar stacking surfaces;

first and second spaced apart T-shaped formations located at the rear of said block body, and defining therebetween a T-shaped vertical fastener channel and opposing vertical side grooves, and wherein said vertical fastener channel is adapted for receiving a complementary T-shaped formation of a rearwardly placed embedment block, and wherein said vertical side grooves are adapted for cooperating with vertical side grooves of adjacent like wall blocks to selectively receive a wall insert; and a shear lug formed with said intermediate block wall between said first and second T-shaped formations and projecting from one of the planar stacking surfaces of said block body.

15. The retaining wall according to claim 14, and comprising a block-locating jut formed with at least one of the opposing sides of said block body, and projecting from the side towards one of the planar stacking surfaces, and wherein said block-locating jut defines a base surface substantially coplanar with the stacking surface of said block body, and a lug-engaging shoulder adapted for engaging a shear lug of a wall block located in an adjacent stacked course.

16. The retaining wall according to claim 15, wherein said block-locating jut projects from the side of said block body at a point intermediate the top and bottom towards the planar stacking surface.

* * * * *